US007389888B2

(12) United States Patent
Willim

(10) Patent No.: US 7,389,888 B2
(45) Date of Patent: Jun. 24, 2008

(54) MOBILE CRANE WITH BALLASTING

(75) Inventor: Hans-Dieter Willim, Ulm-Unterweiler (DE)

(73) Assignee: Liebherr Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 11/584,241

(22) Filed: Oct. 20, 2006

(65) Prior Publication Data

US 2007/0090074 A1 Apr. 26, 2007

(30) Foreign Application Priority Data

Oct. 26, 2005 (DE) ..... 20 2005 016 815 U

(51) Int. Cl.
*B66C 23/72* (2006.01)

(52) U.S. Cl. ..... 212/178; 212/195

(58) Field of Classification Search ..... 212/178, 212/195

See application file for complete search history.

(56) References Cited

U.S. PATENT DOCUMENTS 4,196,816 A * 4/1980 Dvorsky et al. ..... 212/195

* cited by examiner

*Primary Examiner*—Thomas J. Brahan
(74) *Attorney, Agent, or Firm*—Alleman Hall McCoy Russell & Tuttle LLP

(57) ABSTRACT

The present disclosure relates to a mobile crane comprising an undercarriage and a superstructure arranged in a revolving manner thereon with a device for the reception of ballast. In accordance with the present disclosure, the device for the reception of ballast comprising at least three pulling means which can be moved up and down vertically and which can be connected to a pallet or base plate carrying the ballast and located beneath the total center of gravity of the ballast to pull the pallet or base plate toward the superstructure and to connect it to it or to let it down from it.

12 Claims, 4 Drawing Sheets

MOBILE CRANE WITH BALLASTING

CROSS REFERENCE TO RELATED APPLICATION

This application claims priority to German Utility Model Application No. 20 2005 016 815.7, filed Oct. 26, 2005, which is hereby incorporated by reference in its entirety for all purposes.

FIELD

The present disclosure relates to a mobile crane comprising an undercarriage and a superstructure arranged in a revolving manner thereon with a device for the reception of ballast.

BACKGROUND AND SUMMARY

Whereas the ballast is arranged at the rear part of the superstructure during the operation of the crane, it is removed from the superstructure on the transporting journey of the mobile crane and placed on the undercarriage or on a separate transport vehicle to take account of the axle loads of the undercarriage. A number of devices for the reception of the ballast are already known. As a rule, they have hydraulic cylinder arrangements arranged at right angles to the superstructure which can be connected to the respective ballast packages or ballast pallets to lift them onto the superstructure.

It is the object of the present disclosure to provide a mobile crane in which the device for the reception of the ballast can be integrated into the superstructure of the mobile crane in as space-saving a manner as possible.

This object is solved in accordance with the present disclosure by a mobile crane comprising an undercarriage and a superstructure arranged in a revolving manner thereon with a device for the reception of ballast, where the device for the reception of ballast includes at least three pulling means which can be moved up and down vertically and which can be connected to a pallet or base plate carrying the ballast and located beneath the total center of gravity of the ballast to pull the pallet or base plate toward the superstructure and to connect it to it or to let it down from it. The ballast placed on a pallet or base plate can be taken up securely and moved on and off by means of these pulling means even with a high center of gravity, with it being of particular advantage here that the ballast can also be picked up off the floor.

Various additional features may also be included. Lugs can be arranged at the superstructure with which the pallet can be bolted for fastening to the superstructure. If therefore the ballast is pulled up to the superstructure via the balancers, the lugs lie in corresponding cut-outs of the pallet carrying the ballast and can then be bolted there via suitable bolts.

In accordance with a further preferred aspect of the present disclosure, the pulling means can extend horizontally in the revolving deck of the superstructure and can be sheared in a multiple manner. Due to the multiple shearing, for example a dual shearing, double the lifting movement of the ballast can be carried out with a corresponding movement of the pulling means in the longitudinal direction of the superstructure.

Chains or ropes can be used as pulling means in accordance with the present disclosure.

When ropes are used, they can be broken down, for example, into eight flat ropes which in turn consist of five individual ropes. This has the advantage that the rope pulleys can be made very small with respect to their diameter ratio (D/d ratio) so that the pulley blocks can be arranged in the relatively low available construction height of the revolving deck of the superstructure.

At least one hydraulic cylinder can be arranged horizontally or slightly inclined in the revolving deck of the superstructure in order to move the pulling means up and down by extension or contraction. It is ensured by this horizontal or slightly inclined installation in the revolving deck of the superstructure that the revolving deck does not have a high construction.

A respective hydraulic cylinder with the associated ropes, the pulley blocks and the balancers preferably form an assembly which can be inserted into the revolving deck for installation and can be bolted thereto. In an embodiment having four balancers, two assemblies are typically provided which can each be installed laterally between two side walls in the revolving deck.

BRIEF DESCRIPTION OF FIGURES

Further features, details and advantages of the present disclosure will be explained in more detail with reference to embodiments shown in the drawings.

DETAILED DESCRIPTION

Figure 1:
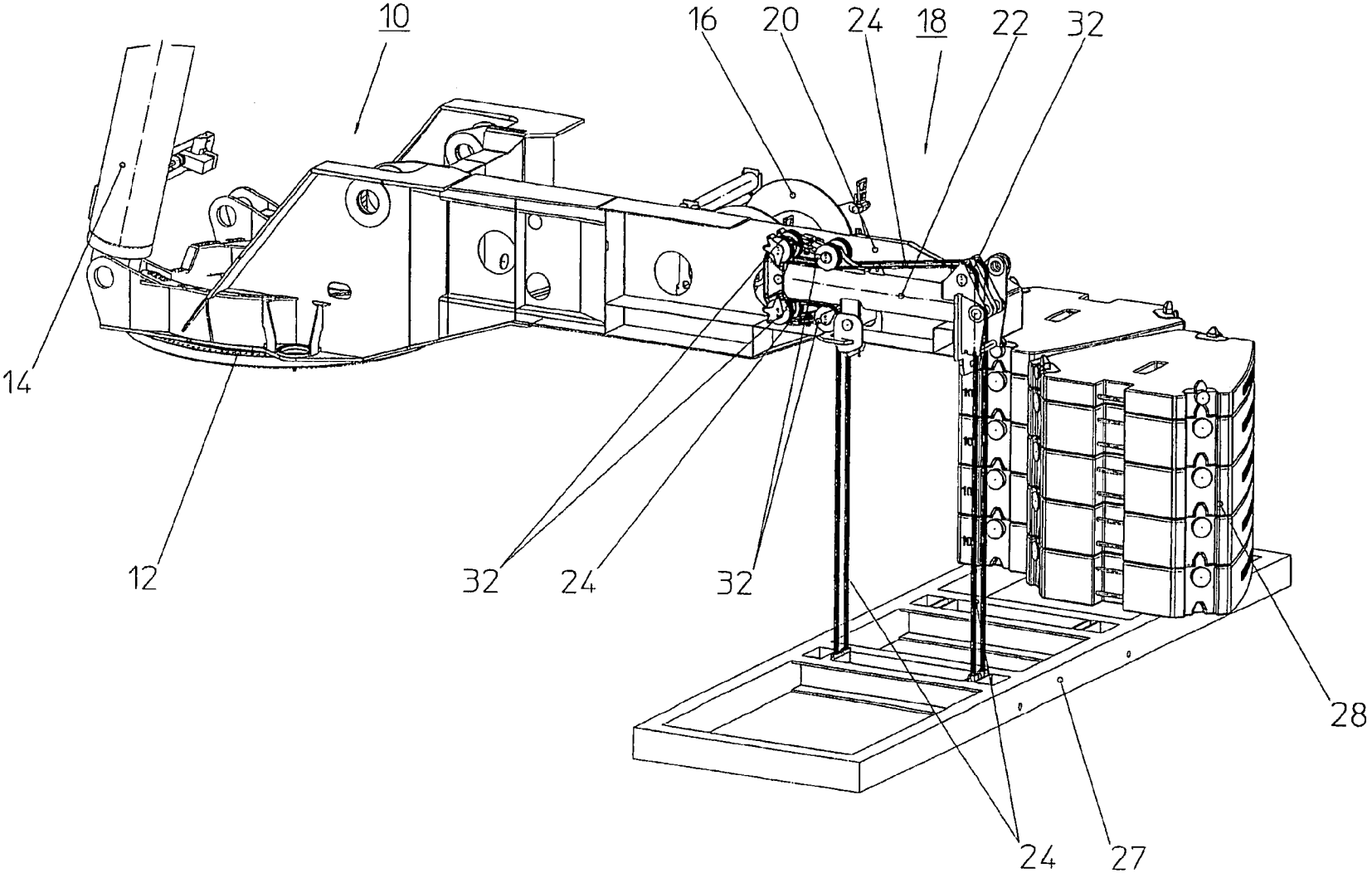
FIG. 1 shows a part of a revolving deck of a mobile crane in accordance with the present disclosure with a device for the reception of a ballast shown in part here.
Figure 2:
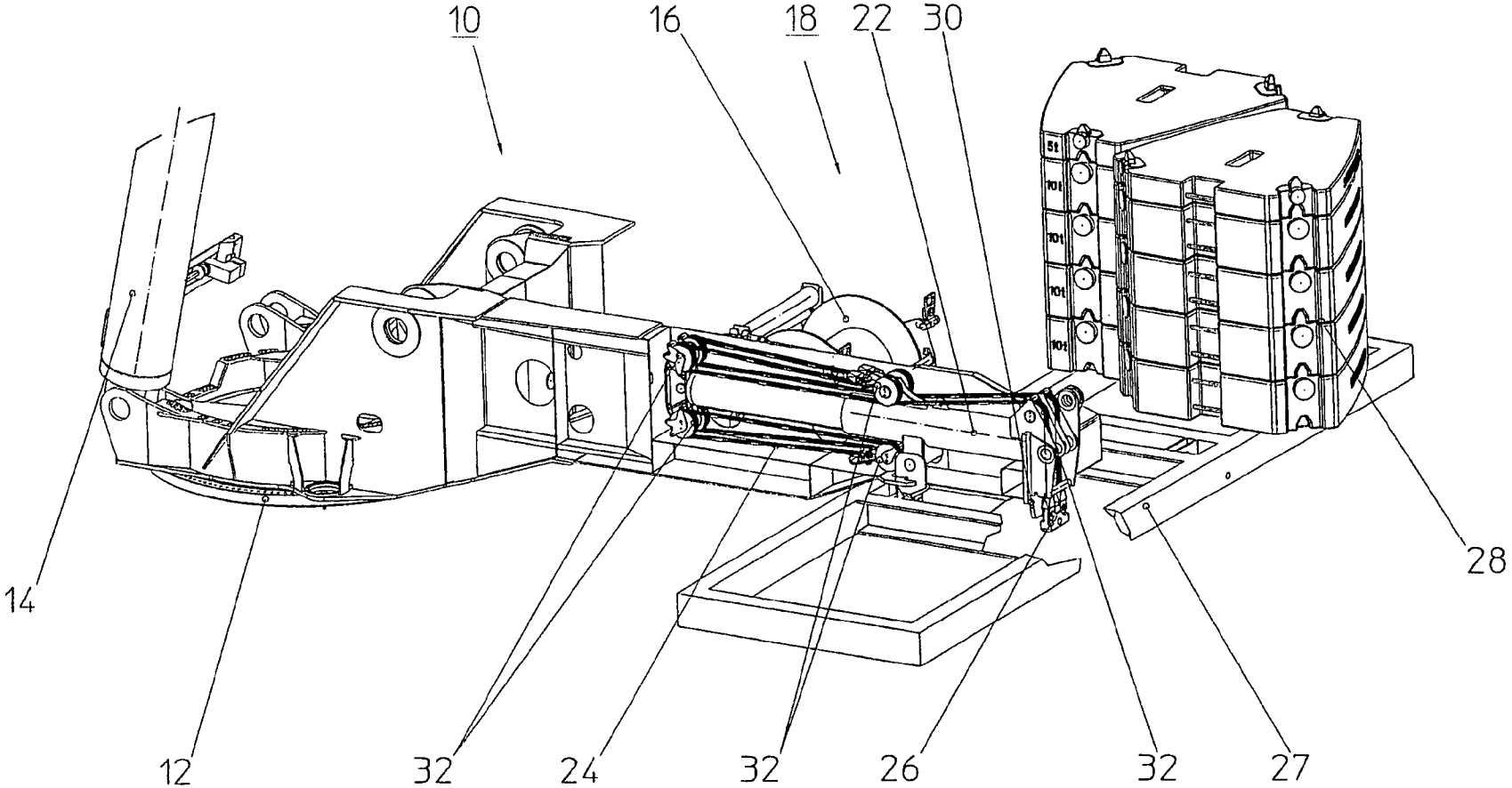
FIG. 2 shows a revolving deck as in FIG. 1, but in a different working position.

In FIG. 2, a revolving deck 10 of a mobile crane is shown in which a swiveling crown 12, a luffing ram 14 for the boom not shown in any more detail here and a hoist rope winch 16 are made in the typical manner. A device 18 for the reception of ballast is integrated in the revolving deck 10. This device includes two units of the same structure of which only one unit is shown in FIG. 1. This unit 18 is made as an assembly and can be installed as a whole between two side walls 20 (only one is shown here) of the revolving deck 10. An assembly 18 includes a hydraulic cylinder 22 which is installed horizontally into the revolving deck in the embodiment shown here. Furthermore, two horizontally extending ropes 24 are doubly sheared between rollers 32. Thus, while this example illustrates four pulling, or suspending, members (two on each unit) which can be moved up and down vertically and which can be connected to the pallet or base plate carrying the ballast, in an alternative embodiment only three members may be needed. Such an example illustrates two units with an asymmetric number of pulling members. Further, still other numbers of pulling members may be used, if desired.

As shown in FIG. 2, balancers 26 are arranged at the ropes, with two balancers being shown here. Overall, four balancers 26 therefore result on a doubling of the corresponding ballast reception devices 18.

The balancers 26 can be moved up and down by shortening or extending the ropes. They are shown in the let down position in FIG. 1, whereas they are shown in the drawn up position in FIG. 2. The shortening or extending of the ropes takes place via the hydraulic cylinder 22. The hydraulic cylinder 22 is shown completely retracted in FIG. 1 so that the ropes 24 and thus the balancers arranged thereon are completely let down. In this position, they can be bolted to a pallet 27 which takes up ballast plates 27 on its sides in each case. By moving out the hydraulic cylinder 22, the ropes 24 are pulled up so that the balancers 26 are pulled up into the position in accordance with FIG. 2. The pallet 27 hereby moves into a position directly below the revolving deck in which fastening lugs 30 plunge into corresponding recesses of the pallet and can be bolted to the pallet there. In this position, the ballast is connected to the superstructure in a manner ready for operation. The letting down of the ballast takes place in the reverse order.

Figure 3:
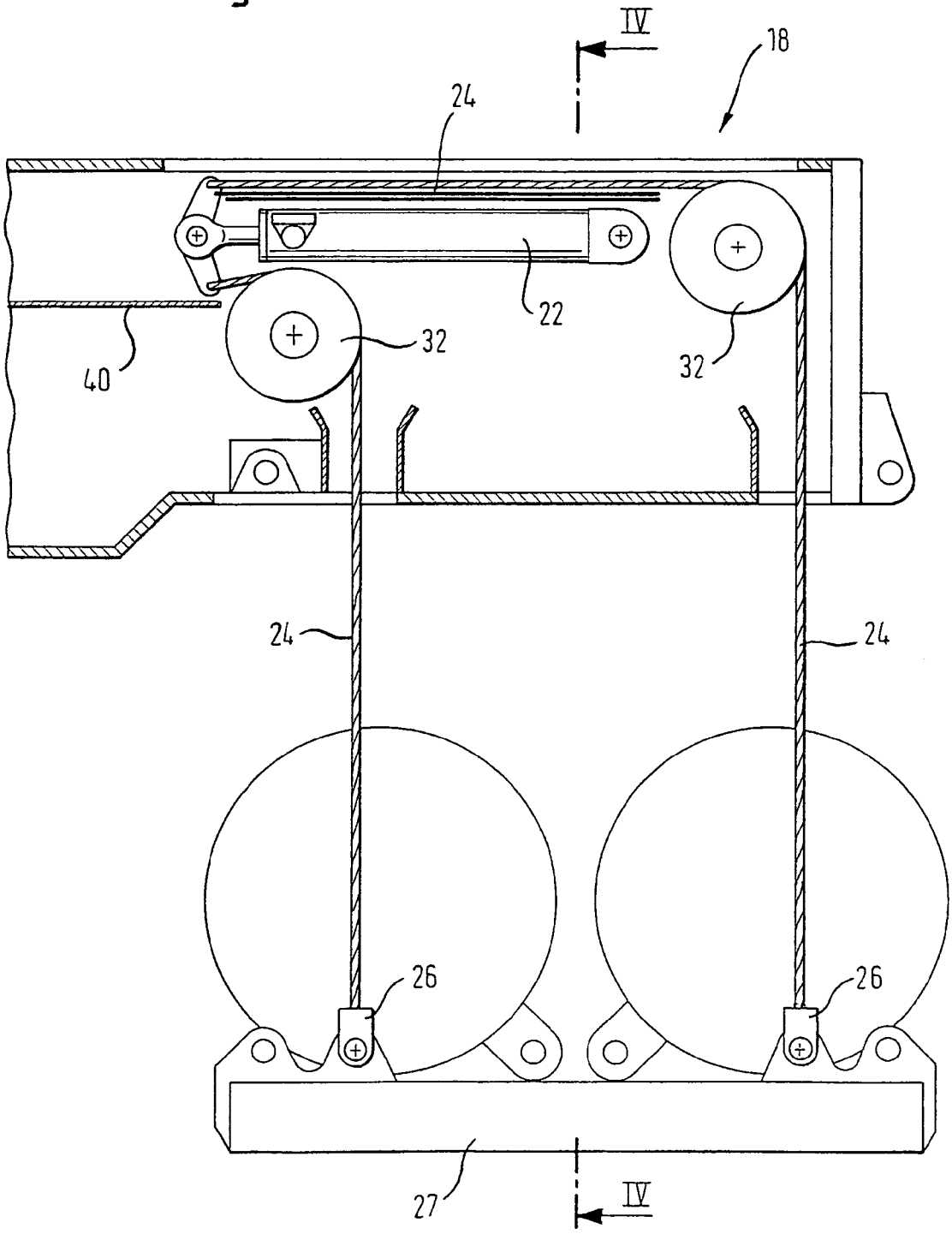
FIG. 3 shows a partial sectional representation of the device for the reception of the ballast in accordance with FIG. 1.
Figure 4:
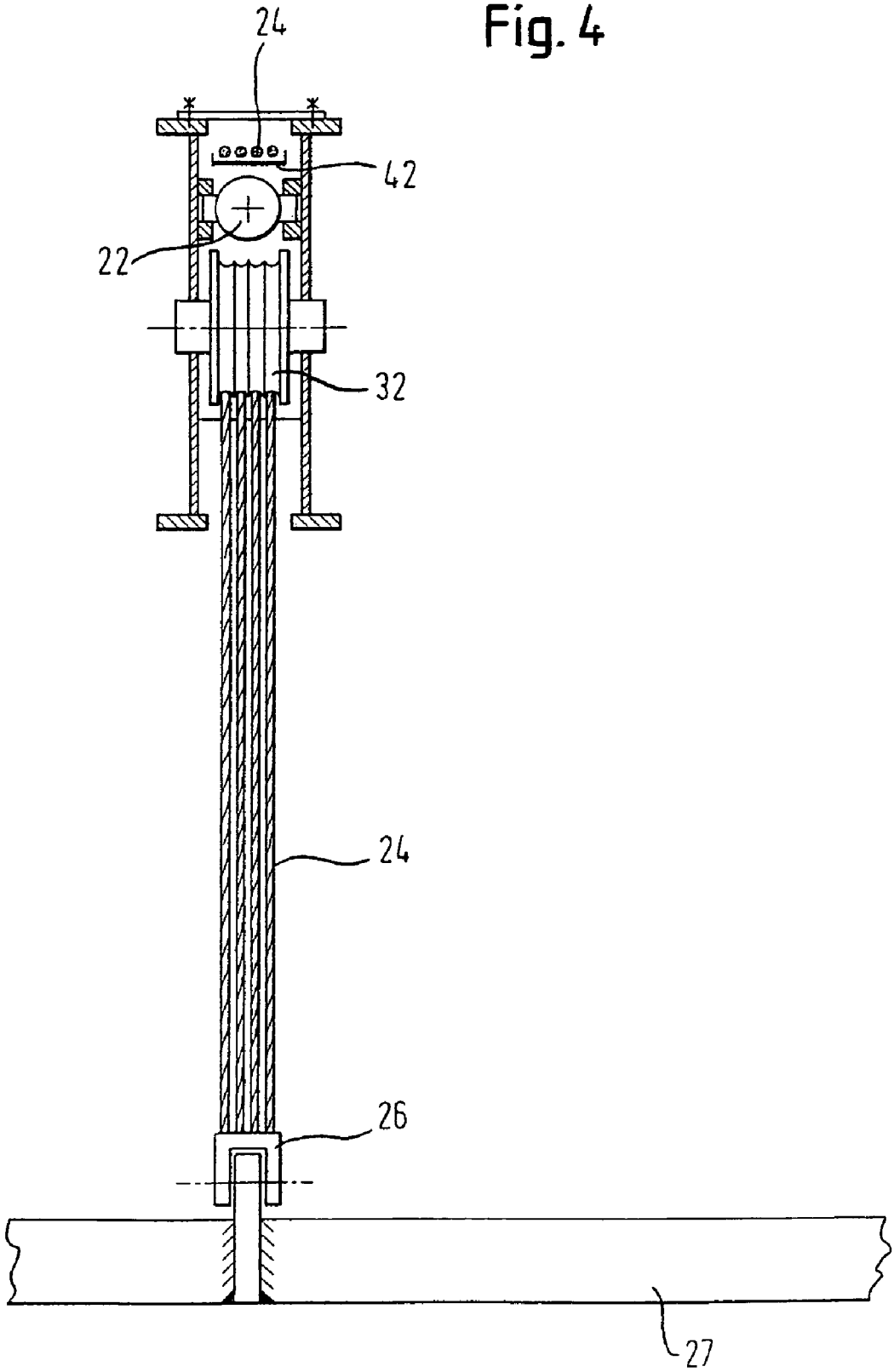
FIG. 4 shows a section along the sectional line IV-IV in accordance with FIG. 3.

In FIGS. 3 and 4, the set-up of the ballast reception devices 18 is shown in further detail. One can first in particular recognize from the sectional drawing in accordance with FIG. 3 a rope guide body 40 for the lower ropes 24 and from FIG. 4 a rope guide body 42 for the guidance of the upper ropes. The hydraulic cylinder 22 is retracted in FIGS. 3 and 4 so that the ropes 24 are pulled out in this position and the ballast plate 27 has been moved downwardly. By corresponding moving out of the hydraulic cylinder 22, the ropes 24 are deflected around the rollers 32 and moved along the tracks 40 and 42. So that the complete movement of the hydraulic cylinder 22 can be followed, the rope guide body 42 for the upper ropes 24 can be pulled out.

The ballast can also be taken up securely with a high-set center of gravity due to the four abutment points which are present.

The ballast can advantageously be taken up directly from the floor with the ballasting proposed here so that the setting of the ballast blocks 28 can take place at a low height.

If a transport vehicle of corresponding bearing capacity is present, the ballast can be set down directly onto the transport vehicle without a further auxiliary crane. The ballast can then be taken up directly by the transport vehicle at a new deployment location. This is in particular of advantage on the assembly of wind generators.

The ropes 24 are broken down into a total of eight flat ropes which each in turn are comprised of five single ropes. This has the advantage that the rope pulleys 32 can be made very small with respect to their diameter ratio so that these rope pulleys or pulley blocks 32 can be accommodated in the relatively low available construction height.

When the ballast 27 is pulled up to the revolving deck 10, the ballast centers automatically in that the ballast oscillates to perpendicular under the four suspension points.

The invention claimed is:

1. A mobile crane comprising an undercarriage and a superstructure arranged in a revolving manner thereon with a device for the reception of ballast the device for the reception of ballast comprising at least three pulling means which can be moved up and down vertically and which can be connected to a pallet or base plate carrying the ballast and located beneath a total center of gravity of the ballast to pull the pallet or base plate toward the superstructure and to connect it to it or to let it down from it, wherein the pulling means extend approximately horizontally in the revolving deck of the superstructure and are sheared in a multiple manner.

2. A mobile crane in accordance with claim 1, wherein lugs are arranged at the superstructure with which the pallet can be bolted to the superstructure for fixing.

3. A mobile crane in accordance with claim 1, wherein chains are used as the pulling means.

4. A mobile crane in accordance with claim 1, wherein ropes are used as the pulling means.

5. A mobile crane in accordance with claim 4, wherein the ropes are broken down into eight flat ropes which in turn consist of five single ropes.

6. A mobile crane in accordance with claim 1, wherein at least one hydraulic cylinder is arranged horizontally or slightly inclined in the revolving deck of the superstructure to move the pulling means up and down by extension or contraction.

7. A mobile crane in accordance with claim 6, wherein a hydraulic cylinder, ropes, pulley blocks and balancers are made as an assembly which can be inserted into the revolving deck for installation and can be bolted thereto.

8. A device for the reception of ballast for a crane having an undercarriage and a superstructure arranged in a revolving manner thereon, the device comprising:

at least three pulling members, each moveable up and down vertically and connectable to a pallet or base plate carrying the ballast and located beneath a total center of gravity of the ballast to pull the pallet or base plate toward the superstructure and to connect it to it or to let it down from it, wherein the pulling members extend approximately horizontally in the revolving deck of the superstructure and are sheared in a multiple manner.

9. A mobile crane in accordance with claim 8, wherein the pulling members comprise flexible lines.

10. A mobile crane in accordance with claim 9, wherein the pulling members comprise chains or ropes.

11. A mobile crane in accordance with claim 10, wherein at least one hydraulic cylinder is arranged horizontally or slightly inclined in the revolving deck of the superstructure to move pulling members up and down by extension or contraction, where at least four pulling members are used.

12. A mobile crane in accordance with claim 11, wherein the hydraulic cylinder, the ropes, pulley blocks and balancers are made as an assembly which is inserted into the revolving deck for installation and bolted thereto.

* * * * *